US005393639A

United States Patent [19]

Kourepenis

[11] Patent Number: 5,393,639

[45] Date of Patent: Feb. 28, 1995

[54] IMAGING LAMINATE

[75] Inventor: Steven Kourepenis, Watertown, Mass.

[73] Assignee: Polaroid Corporation, Cambridge, Mass.

[21] Appl. No.: 981,287

[22] Filed: Nov. 25, 1992

[51] Int. Cl.[6] ..... G03C 3/00

[52] U.S. Cl. ..... 430/254; 430/253; 430/256; 430/964

[58] Field of Search ..... 430/200, 253, 254, 964, 430/256

[56] References Cited

U.S. PATENT DOCUMENTS

| | | | |
|---|---|---|---|
| 3,924,041 | 12/1975 | Miyayama et al. | 428/212 |
| 4,157,412 | 6/1979 | Deneau | 428/147 |
| 5,169,475 | 12/1992 | Tobin | 156/344 |
| 5,229,247 | 7/1993 | McCarthy et al. | 430/253 |

FOREIGN PATENT DOCUMENTS

| | | |
|---|---|---|
| 0544334A1 | 6/1993 | European Pat. Off. . |
| 8804237 | 6/1988 | WIPO . |

*Primary Examiner*—Charles L. Bowers, Jr,
*Assistant Examiner*—Geraldine Letscher
*Attorney, Agent, or Firm*—Louis G. Xiarhos; Renato M. de Luna

[57] ABSTRACT

A thermally imageable laminar composite comprising a pair of opposed sheets confining therebetween a frangible layer of image-forming substance partitionable to the respective sheets on separation of the sheets after thermal imaging is protected against premature stress-induced delamination by the heat bonding of the opposed sheets to one another through said image-forming substance at the periphery of said composite, said bonding being at a strength substantially greater than that required to separate said sheets in the expansive thermally imageable region confined by said periphery. A method for preparing individual units of an imageable composite, including the steps of establishing a band-like heated zone in a supply web of laminate, corresponding to the boundaries of a unit to be cut therefrom, and cutting a unit from within said band-like zone is described.

20 Claims, 5 Drawing Sheets

IMAGING LAMINATE

BACKGROUND OF THE INVENTION

This invention relates to an imaging laminate having between a pair of sheets a layer of frangible image-forming substance separable to the respective sheets thereof. More particularly, it relates to a laminar structure particularly adapted to separation of the sheets thereof by mechanical apparatus.

Laminar imaging materials comprising a pair of sheets and a layer of image-forming substance therebetween have been known. For example, laminar thermal imaging materials for the production of images by exposure to heat and separation of the sheets thereof have been described in U.S. Pat. No. 3,924,041 (issued Dec. 2, 1975 to M. Miyayama, et al.); in U.S. Pat. No. 4,157,412 (issued Jun. 5, 1979 to K. S. Deneau); and in International Patent Application No. PCT/US87/03249 of M. R. Etzel (published Jun. 16, 1988 as International Publication No. WO 88/04237). It will be appreciated that an image-forming substance confined between a pair of sheets will be protected against abrasion and ruboff. In addition, a laminar medium can be handled as a unitary structure, thus, obviating the requirement of bringing the respective sheets of a two-sheet imaging medium into proper position in a printer or other apparatus used for imaging of the medium material.

As is disclosed in the aforementioned International Application PCT/US87/03249, the image-forming substance of the thermally imageable medium thereof is caused to be adhered weakly to a first sheet, for example, by coating a layer of the image-forming substance onto an image-forming surface of the first sheet, the image-forming surface comprising, for example, a subcoat of polymeric material which is heat-activatable to an altered physical condition upon subjection to the heat generated by brief and intense imaging radiation. The layer of image-forming substance (e.g., pigment material in a binder therefor) is designed to fracture vertically, i.e., in a direction normal to the surface of the layer, such that, portions of the layer of image-forming substance subjected to brief and intense irradiation and rapid cooling are caused to become attached more firmly or locked to the first sheet through the influences of the heated image-forming surface. Portions not subjected to such influences and remaining weakly adhered to the first sheet are removed to the opposed and second sheet of the laminate upon separation of the respective sheets thereof after imaging.

Vertical frangibility of the image-forming layer permits the production of images of desirably high resolution and optical density. Moreover, image resolution is promoted by the adhesion of the vertically frangible image-forming substance only weakly to the image-forming surface or zone of the first sheet and is reduced by a too-strong adhesion, as a consequence of which, minute pels or portions of image-forming substance not exposed to heat may undesirably remain adhered to the first sheet and not be removed to the second sheet on separation of the sheets of the laminate. Desirably, the image-forming substance will be adhered to the first sheet sufficiently to prevent accidental dislocation (separation) from the image-forming surface or zone of the first sheet and consistently with the particular requirements of image resolution and density.

In the copending and commonly assigned U.S. patent application of William P. Tobin, U.S. Ser. No. 07/616,796, filed Nov. 21, 1990, there are disclosed certain preferred thermal imaging materials, in the form of individually sized (formatted) thermally imageable laminates. Individual (formatted) thermally imageable laminates of the type shown in U.S. patent application Ser. No. 07/616,796 can be stacked in a cassette or tray for supply to a drum or other zone of a printing apparatus and, after thermal exposure, can be separated by an automated delamination device described therein. It will be appreciated that, depending upon the degree of adhesion of the image-forming substance to the image-forming surface or zone of the first sheet, subjection of the sheets to physical stresses in the form, for example, of shock or bending, may cause premature delamination of the laminate at the weakest interface thereof, i.e., at the interface of the layer of image-forming substance and the image-forming surface or zone of the first sheet. Undesired and premature delamination can also occur during the manufacture of laminar units. Individual imageable units will, for example, typically be cut from a web of laminar material having image-forming material confined between a pair of sheets. Cutting, slitting and stamping operations used during the manufacture of laminar units can create stresses, particularly at the periphery of the units, which cause delamination. Delamination initiated at the periphery or at an edge of a unit and propagated through the expansive portion of the unit will render the unit useless and is desirably to be avoided.

SUMMARY OF THE INVENTION

It has been found that the tendency of a thermally imageable individually sized laminar unit of the aforedescribed type to delaminate undesirably upon application of physical stress can be reduced by resort to a construction and method whereby opposed separable sheets of the unit are prebonded to one another about the periphery of the sheets by application of heat sufficient to secure the sheets at the periphery to a strength requiring, for separation of the sheets at such periphery, a substantially greater peel force than that required to separate the sheets in the expansive thermally imageable region confined by such periphery.

In an article aspect, the present invention provides a thermally imageable laminar composite structure, said structure comprising:

a frangible layer of an image-forming substance, said layer having first and second opposite surfaces;

a first sheet having an image-forming surface or zone adhered to said first surface at a first strength, abutting areas of said frangible layer being, upon exposure of said composite structure to intense image-forming radiation, adherable to said image-forming surface or zone at a strength greater than said first strength;

a second sheet adhered to said second surface at a predetermined substantially uniform strength, said predetermined substantially uniform strength being greater than said first strength and less than said second strength;

each of said first and second sheets of said composite structure being separable from each other, separation of said sheets after said exposure to said intense image-forming radiation being effective to provide portions of said frangible layer of image-forming substance on each of the separated sheets;

said first and second sheets of said composite structure being bonded through said layer of image-forming substance and to each other about a border region conforming to the periphery of said sheets, at a strength substantially greater than the force required to separate said sheets in the region of said composite structure confined by said border region;

said image-forming substance upon separation of said first and second sheets being adhered in said border region to one of said sheets, thereby to provide on said one sheet a border in said image-forming substance.

According to a method aspect of the present invention, there is provided a method of preparing a unitary laminar composite structure, said method comprising the steps of:

providing a supply web of a composite laminar structure, said web structure comprising a frangible layer of an image-forming substance having first and second opposite surfaces, a first sheet having an image-forming surface or zone adhered to said first surface at a first strength, abutting areas of said frangible layer being, upon exposure of said composite laminar structure to intense image-forming radiation, adherable to said image-forming surface or zone at a strength greater than said first strength, and a second sheet adhered to said second surface at a predetermined substantially uniform strength, said predetermined substantially uniform strength being greater than said first strength and less than said second strength, each of said first and second sheets of said web of composite laminar structure being separable from each other, separation of said sheets after said exposure to said intense image-forming radiation being effective to provide portions of said frangible layer of image-forming substance on each of the separated sheets of said composite laminar structure;

establishing a heated band-like zone corresponding substantially to the predetermined perimetric dimensions of a composite laminar unit to be cut from said supply web of said composite laminar structure;

cutting the perimeter of said unit substantially within said band-like zone and through said supply web of said composite laminar structure; and removing said unit from said supply web.

BRIEF DESCRIPTION OF THE DRAWINGS

Reference is made to the accompanying drawings in which there are shown illustrative embodiments of the invention, from which its novel features and advantages will be apparent, wherein.

DETAILED DESCRIPTION OF THE INVENTION

Figure 1:
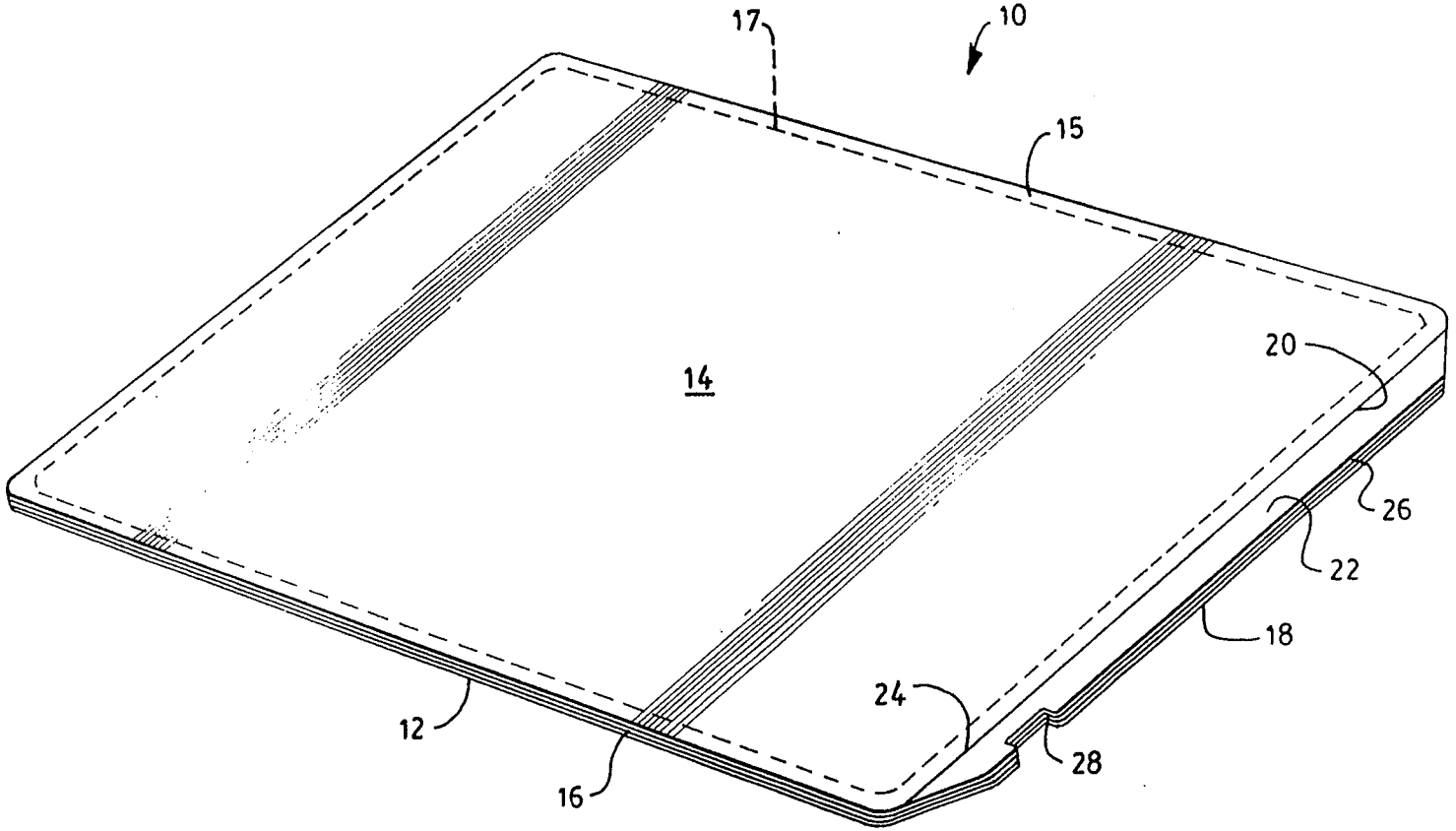
FIG. 1 is a perspective view of a preferred embodiment of a composite laminar structure of the invention.
Figure 2:
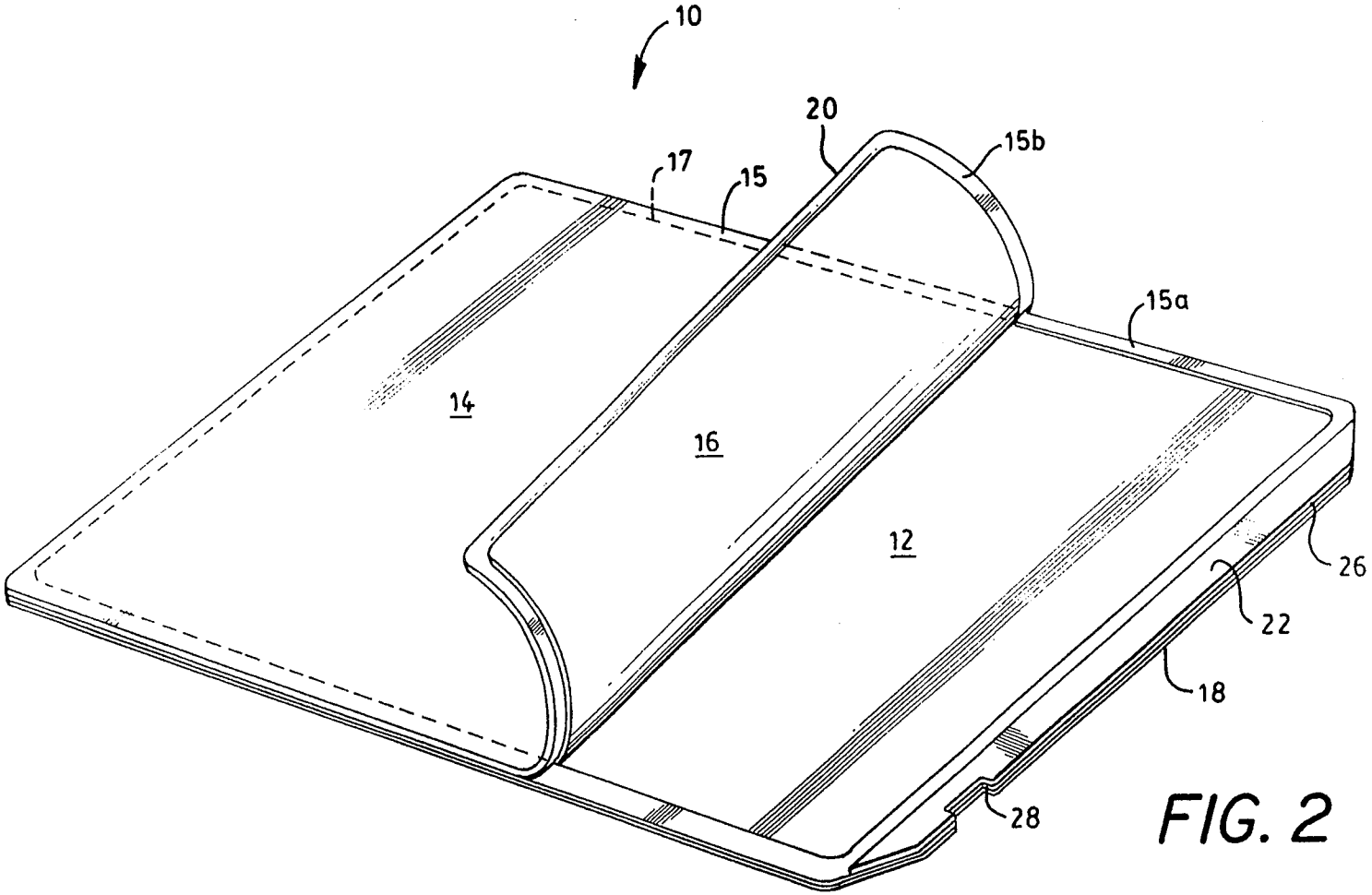
FIG. 2 is a perspective view of the embodiment of FIG. 1, the respective sheets of the unexposed, i.e., non-imaged, composite laminar structure thereof being shown in a state of partial separation.
Figure 3:
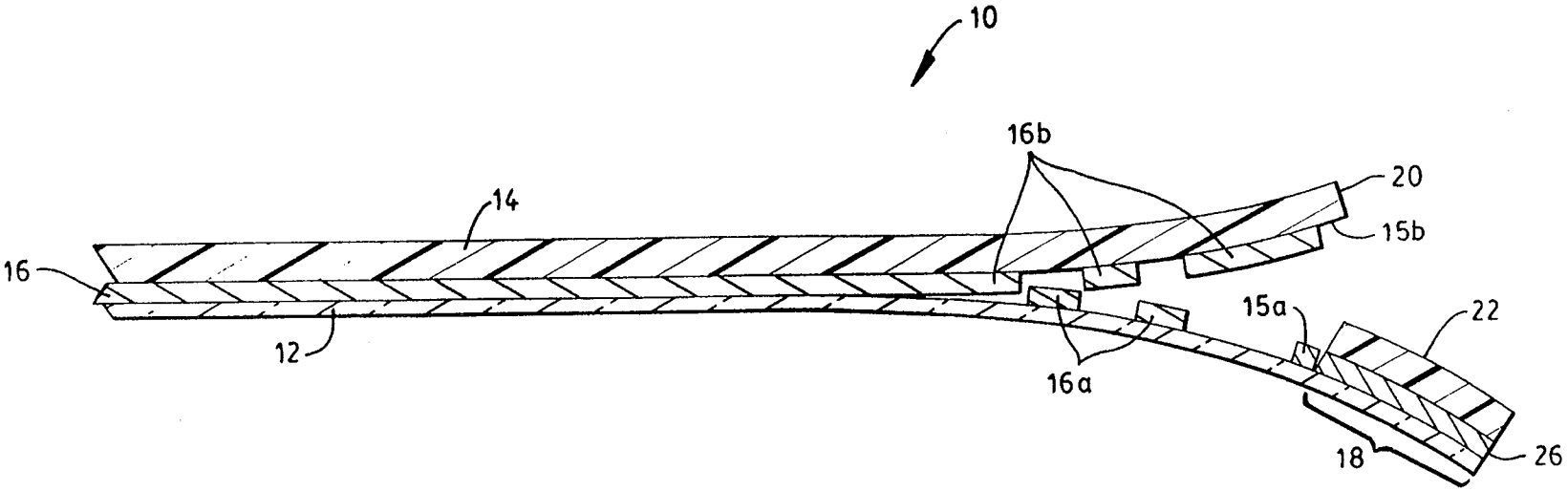
FIG. 3 is a view in longitudinal section of the composite laminar structure of FIG. 1, the respective sheets thereof being shown in a state of partial separation after exposure, i.e, imaging of the composite laminar structure, certain aspects of its separation into complementary images being shown, with layer thicknesses being exaggerated for clarity.

Referring now to the drawings, and particularly to FIGS. 1, 2 and 3, a laminar composite structure 10 is shown in a preferred embodiment as a thermal imaging film unit of the general kind disclosed by the aforementioned International Application PCT/US 87/03249 and the aforementioned patent application of W. P. Tobin, U.S. Ser. No. 07/616,796. The film unit comprises support sheets 12 and 14, each adhesively connected to opposite surfaces of a frangible layer 16 of image-forming substance 16. For purposes of the present invention, it is sufficient to note that layer 16 is such that it may be ruptured or fractured in a direction normal to its two surfaces, i.e., along lines defined by exposure, as is described in the International Application, supra.

As shown in FIG. 2, separation of sheets 12 and 14 prior to laminar composite structure 10 being subjected to thermal exposure results in adhesion of layer 16 of image-forming substance to sheet 14. Subjection of the laminar composite structure 10 of FIG. 1 to intense radiation for imaging results, as shown in FIG. 3, in portions of layer 16 subjected to exposure being separated from portions not affected by exposure, to provide complementary images on the respective sheets of the composite sheet structure.

As used herein, reference to vertical frangibility of layer 16 is intended to refer to the capacity of abutting portions of the layer 16 of image-forming substance to be separated, as a function of a predetermined imaging exposure of the composite laminar structure, along a direction normal to the surfaces of the layer. Thus, on separation of the respective sheets of the composite laminar structure, a pair of complementary images of desired high resolution and optical density is obtained. It will be understood that the separation of abutting regions or areas of frangible layer 16 for production of complementary images in image-forming substance will require that the layer have sufficient cohesivity as to preclude the partitioning of regions of layer 16 by fracture between its surfaces, i.e., along horizontal lines. Since layer 16, as described in greater detail hereinafter, can be associated with additional layers for proper imaging of the composite structure, cohesive failure along horizontal lines is permissible and desirable in particular instances, provided that such failure does not occur within a layer, such as a pigment layer, which provides desired optical density.

As used herein, and except where otherwise specified, "adhesion" of a layer or "connection" of a layer to a sheet or other layer or surface refers to adhesion or connection either directly or indirectly. Thus, the layer can be adhered or connected to a sheet or other layer or surface by being contiguous therewith or by adhesion or connection through one or more other layers.

According to a preferred embodiment of the composite laminar structure 10 of FIG. 1, layer 16 will comprise a frangible layer of image-forming substance such as a layer of colorant (e.g., carbon black) in a suitable binder. Such a layer can be deposited onto sheet 12 using known coating methods, for provision of a thin layer having desired and predetermined optical density.

Sheet 12 can comprise polyester or other material having, for example a subcoat of heat-activatable polymeric material (not shown) for more firm attachment of exposed regions of layer 16 to sheet 12 as a function of a laser exposure. In general, layer 16 will comprise a frangible layer which is adhered to sheet 12 at a first strength sufficient to prevent accidental dislocation, but which as a function of exposure can be more firmly secured to sheet 12 at a second and greater strength.

In the embodiment of FIG. 1, sheet 14 will typically be adhered to the layer 16 of image-forming substance through adhesive and release layers (not shown). Sheet 14 is adhered to layer 16 at a strength (referred to previously as the "second" strength) which is greater than the aforementioned first strength, such that, the layer 16 of image-forming substance is adhered to sheet 14 on separation of the sheets prior to exposure. The removal to sheet 14 of layer 16 of image-forming substance, on separation of the sheets without imaging exposure, can be best seen in FIG. 2.

Layer 16 of image-forming substance, adhered to sheet 12 at a strength (the "first" strength) predetermined to prevent accidental removal can be connected or attached more firmly to an image-forming surface of sheet 12 by thermal exposure through sheet 12. As a function of exposure and heat activation of the image-forming surface between sheet 12 and layer 16, exposed regions of layer 16 are now connected or attached more firmly to sheet 12, at a strength greater than the aforesaid first strength and greater than the bond strength between sheet 14 and layer 16. Since the adhesion of sheet 14 to layer 16 is greater in non-exposed regions than the initial strength between coated layer 16 and sheet 12, separation of sheets 12 and 14 after image exposure results in non-exposed regions of layer 16 being separated from the layer to sheet 14. As is shown in FIG. 3, and as a result of laser exposure of the depicted and preferred embodiment, portions 16*a* of layer 16 become more firmly bonded to sheet 12. Portions 16*a* of layer 16, and abutting portions 16*b* which have not been affected by heat, may then be separated from each other when the sheets 12 and 14 are delaminated.

Good image resolution is promoted by a weak adhesion of layer 16 of image-forming substance to sheet 12 and ready removal of non-exposed portions (16*b*) thereof to sheet 14. Owing, however, to the low first strength of adhesion, a complete delamination of the article 10 (by detachment of layer 16 from sheet 12 and adhesion to sheet 14) can result by subjection of the article 10 to handling and other physical stresses where the article 10 is not provided with the securement embodied therein by the heat-bonded zone 15 defined by broken line 17 in FIG. 1. The presence of a border region 15 to secure the still separable sheets 14 and 12 together at their outermost boundaries and to reduce the tendency for initiation and propagation of a complete delamination of the sheets of laminate 10 improves materially the handling characteristics of article 10.

As is shown in FIGS. 2 and 3, separation of sheets 12 and 14 (either without imaging exposure in the case of FIG. 2 or after imaging exposure in the case of FIG. 3) results in portion 15*a* of image-forming layer 16 being adhered to sheet 12, to define a border 15*a* in image-forming substance. Correspondingly, a border 15*b* is defined about the periphery of sheet 14, and where sheet 14 is a transparent sheet, border 15*b* will appear as a clear border, owing to the absence of image-forming material and adhesion of the image-forming substance to sheet 12 as border 15*a*. Where sheet 14 is an opaque sheet, the opaqueness characteristic of the sheet will be apparent in border 15*b*.

Borders 15*a* and 15*b*, as shown in FIGS. 2 and 3 on respective sheets 12 and 14 serve an aesthetic purpose. In the case, for example, of an image on a clear or transparent sheet 14 principally comprising high density and widely expansive portions 16*b* of image-forming substance such as carbon black, the predominantly opaque image (characteristic of a negative or x-ray image typically used in medical applications) will be surrounded by a clear or transparent border. Correspondingly, the image on sheet 12 in widely expansive clear regions and regions 16*a* of opaque image-forming substance will be surrounded by an opaque border 15*a*. It will be appreciated that while each of the respective sheets has an aesthetically pleasing border, the principal purpose of a securely bonded zone or border 15 is to prevent inadvertent and premature delamination (separation) of the sheets of thermally imageable medium 10.

Border region 15 can be established in article 10 by the application or generation of heat about the periphery of an individual unit of thermally imageable medium 10 or by application or generation of heat in a web of medium material from which individual units 10 can be removed by a cutting or stamping operation. If desired, a pair of opposed and mating heated dies can be brought into contact, respectively, with the outermost surfaces of sheets 12 and 14 of a unitary laminate 10 such as is shown in FIG. 1, thereby to establish a heated zone or border 15 which serves to bond the sheets (through the image-forming substance and any other intermediate layers) to one another at a strength substantially greater than that adhering the laminate in the major and thermally imageable area defined within the heated border region 15.

It will be understood that the application or generation of heat at the border region of a unitary laminate provides a bonding at the borders of the still separable sheets. Unitary laminates can, thus, be subjected to exposure of the main and central region of the laminate to a source of intense radiation and can be traversed to a mechanical separation (peeling) device for separation (peeling) of the exposed sheets. Separation of the sheets can be effected using a separating or peeling force sufficient to overcome the bonding at the border region at the leading edge of the unitary laminate. Separation of the laminate and formation of border 15*a* in image-forming substance and clear border 15*b* can be seen from FIG. 3.

If desired, heat for adhering sheets 12 and 14 in border region 15 can be generated by exposing the region to irradiation and by including a light-absorbing material between the sheets for absorption of the irradiation and generation of heat. Laser sources of irradiation including coherent beams and semiconductor laser arrays can be used for this purpose. A carbon black or other pigment material, such as is used in layer 16 of image-forming substance is an effective light absorber and serves to absorb laser radiation with generation of heat sufficient to promote adhesion between the sheets in the exposed border region 15.

Heat and pressure can be employed to effect adhesion at the borders of a laminate of the invention. A suitable dwell time for this purpose will vary with the nature of the layers of the composite laminate. In general, where heated opposed dies are used, the dies will be preheated to a temperature of about 120° C. to about 137° C. and a short dwell time in the range of from less than one second to normally not more than about ten seconds (e.g., from two to three seconds) will be suitably employed. Typically, good results can be obtained by using pressure in the range of about 20 to about 30 lbs/in$^2$ (about 1,406 to about 2,109 kg/cm$^2$) at temperatures in the range of from about 110° C. to about 127° C. (about 230° F. to about 260° F.).

Bonding of the laminate at the edges or borders can also be accomplished with the aid of chemical adhesion, depending on the nature of the layers between the respective sheets 12 and 14. For example, sheet 14 may be adhered to image-forming layer 16, through one or more additional layers, using a photohardenable adhesive comprising a macromolecular organic binder and a photopolymerizable ethylenically unsaturated monomer. Permeation of ethylenically unsaturated monomer into layers between the respective sheets of the laminate may promote adhesion of the sheets through the intermediate layers. Curing or cross-linking of the adhesive layer can be effected using ultraviolet (UV) irradiation. If desired, UV exposure and cross-linking of the adhesive layer can by masking be confined to the major area of a laminar unit so that tackiness can be promoted by migration or permeation of unpolymerized and uncross-linked monomer into the intermediate layers of the laminate. Preferably, from the standpoint of manufacturing efficiency, border region 15 and the area confined thereby will be simultaneously exposed to blanketwise UV exposure where a UV-curable adhesive is employed.

The mechanism involved in the adhesion of sheets 12 and 14 (and intermediate layers) at border region 15 and the adhesion of border 15*a* to sheet 12 may differ from that employed in the adhesion of portions of layer 16 to sheet 12. Thus, border 15 will typically be formed by application of heat and pressure during the manufacture of a laminar unit.

Laminate units such as shown in FIG. 1 can be manufactured from a supply of endless sheets 12 and 14, each carrying layers appropriate for the construction of a particular medium and by laminating the sheets together and cutting individual units therefrom. A preferred method of preparing individual laminates is shown in FIG. 6 which is a plan view of a section of an endless supply web 50 of a composite laminar structure from which individual units are removed.

Figure 4:
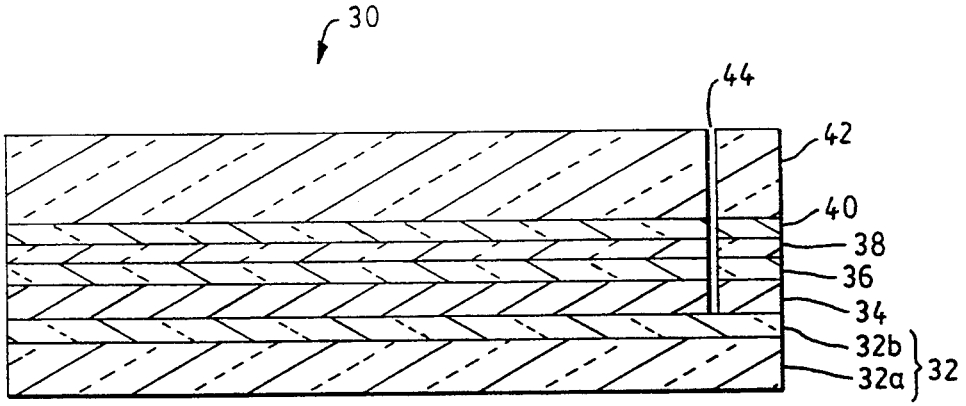
FIG. 4 is a diagrammatic cross-sectional view of another and preferred embodiment of a composite laminar structure of the invention, with thicknesses of its layers being exaggerated for clarity.

A supply web 50 of a composite laminar structure, having a structure such as is shown in FIGS. 1 and 4, is heated to establish a band-like zone or border region 52*a* corresponding generally to the predetermined dimensions (boundaries) of an individual unit 54 to be removed therefrom. Heat applied or generated in region 52*a* can be applied or generated in manners aforedescribed. For example, heated opposed dies can be applied to opposite faces of supply web 50, preferably also, with application of pressure. Alternatively, light (e.g., laser irradiation) can be impinged from either or both sides of supply web 50 for absorption by intermediate pigment or other light-absorbing material and generation of heat requisite for adhering the opposed sheets of laminate 50 and intermediate materials, to a strength as aforedescribed. A laser scanning method can be used to generate the heat for establishing heated zone or border region 52*a*.

Figure 6:
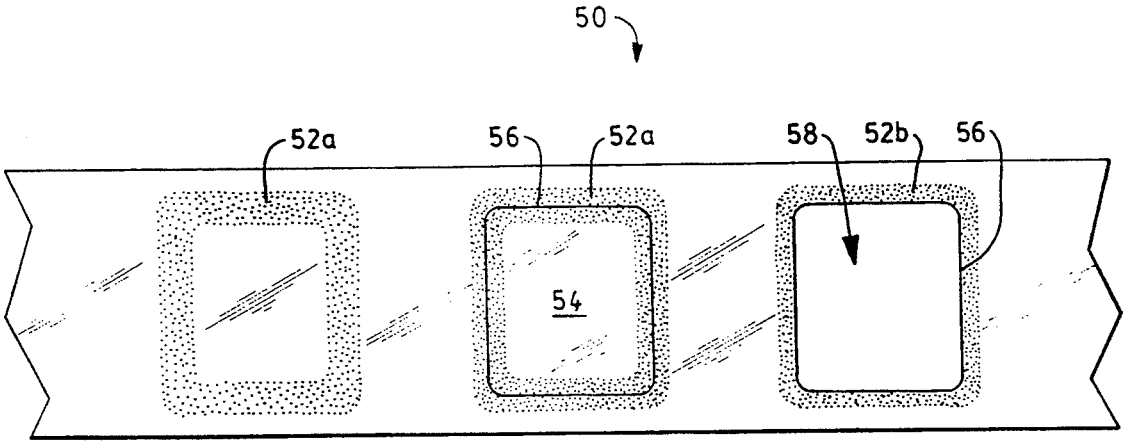
FIG. 6 is a plan view of a section of an endless web of a composite laminar structure, showing certain stages in the production of a composite laminar unit from a web supply.

Shown in FIG. 6 is a cutting stage in which a portion of supply web 50 in which a heated border region 52*a* has been established is provided with a cut 56 to define the perimeter of an individual unit 54 to be removed therefrom. As shown in FIG. 6, cut 56 is confined to border region 52*a*, and on cutting completely through supply web 50, an individual unit 54 is removed therefrom, leaving an opening 58 in supply web 50. Opening 58 defined by cut 56 is surrounded by the residual portion 52*b* of border 52*a*, remaining after removal of unit 54. Cut 56 can be made in a number of ways, including by a rolling knife cutter, reciprocal stamping cutter, a straight-edge cutting knife moved translationally along line 56, a rotary or swing die traversed along line 56 or by a laser cutter. On removal of unit 54 from supply web 50, unit 54 can be subjected to additional treatments, such as may be required depending upon the particular structure desired and the nature of intermediate layers in the structure. Where, for example, unit 54 includes an adhesive layer based upon a macromolecular organic binder and a photopolymerizable ethylenically unsaturated monomer for photohardening of the layer, unit 54 will be subjected to an exposure to UV radiation for photohardening (cross-linking) of the layer.

The laminate structures shown in FIGS. 1 to 5 are provided with a marginal (tab) portion to facilitate separation of the sheets thereof after thermal imaging. The thermally imageable laminate units are designed primarily for processing (sheet separation or delamination) by a mechanical sheet separation or delamination device. The marginal tab portion facilitates the initiation and completion of sheet delamination, to provide complementary images on the respective sheets of the imaged medium material. As best shown in FIG. 1, the individually sized (formatted) thermal imaging laminate 10 thereof includes a marginal or tab portion 18 to facilitate the separation of sheets 12 and 14 after imaging. According to the preferred embodiment shown in FIG. 1, the marginal portion or tab 18 is provided by a score line 20 which severs a marginal portion 22 of sheet 14 and layer 16 of image-forming substance from sheet 12. As seen in FIGS. 1 and 3, tab 18 extends beyond an adjacent margin 20 of sheet 14 and comprises severed portion 22 of sheet 14 and severed portion 26 of layer 16 of image-forming substance.

Separation or delamination of sheets 12 and 14 is accomplished using delamination apparatus such as is described: in the copending and commonly assigned patent application of William P. Tobin, U.S. Ser. No. 07/616,796, filed Oct. 10, 1991 for DELAMINATION MEDIUM, APPARATUS AND METHOD; in the commonly assigned and copending U.S. application Ser. No. 07/799,085 of A. M. Binder for APPARATUS AND METHOD FOR DELAMINATING A COMPOSITE LAMINATE STRUCTURE, filed Nov. 27, 1991; in the commonly assigned and copending application of F. S. Silveira, et al., for APPARATUS AND METHOD FOR DELAMINATION OF A LAMINATE, U.S. Ser. No. 07/800,467, Attorney Docket No. 7721, filed Nov. 27, 1991; and in U.S. Pat. No. 5,141,584, issued Aug. 25, 1992 to D. F. Schuh, et al., for APPARATUS AND METHOD FOR CONTROLLING THE DELAMINATION OF A LAMINATE. Other devices may, however, be employed to effect separation of the sheets of a laminate of the invention.

Separation of sheets 12 and 14 using mechanical apparatus, such as apparatus described in the aforementioned patent applications and issued U.S. patent, involves the application of physical stresses to the common free edge of tab portion 18, sheet portion 22 and portion 26 v of intermediate layer 16. Such stresses can result in delamination of portion 22 of tab 18 from sheet 12 and it will preferred that marginal portion 22 be adhered to sheet 12 substantially more strongly than the remainder of sheet 14. A secure bonding of portion 22 to sheet 12 can be accomplished in a number of ways and, for example, can be effected by resort to mechanical or chemical methods, or by using a combination of mechanical and chemical treatments. Preferably, the securing of marginal portion 22 to sheet 12 will be the result of a convenient operation conducted during the manufacture of the formatted composite laminar structure 10 of FIG. 1. Suitable methods for securing marginal portion 22 to sheet 12 and thermally imageable laminar structures prepared therefrom are described and claimed in the commonly assigned and copending patent application of George O. MacCollum, U.S. Ser. No. 07/799,090, for IMAGING LAMINATE WITH IMPROVED TAB FOR DELAMINATION, filed Nov. 27, 1991.

The sheets 12 and 14 may be made of the same or of different material, polyethylene terephthalate, polystyrene, polyethylene, polypropylene, copolymers of styrene and acrylonitrile, polyvinyl chloride, polycarbonate and vinylidene chloride being some but not all of the material suited as support sheets. They may themselves be laminar structures provided with a backing of paper (not shown) or any other material suited for any specific purpose. It will be understood that the backing material should be transmissive of exposing radiation or be either removable to permit exposure, or positioned on a sheet opposed from that through which exposure is accomplished. While it is not a requirement, it has been found to be advantageous to have one of the sheets stiffer, i.e., less flexible than the other. The difference in stiffness may be provided by a difference in the materials of which the sheets 12 and 14 are made. Preferably, however, and as shown, the different stiffnesses are attained by one of the sheets 12 being thinner than the other sheet 14.

As has been mentioned previously, layer 16 is initially bonded to layer 12 sufficiently to prevent accidental dislocation. Such initial bonding strength facilitates removal of non-exposed regions of layer 16 to sheet 14, in the major imaging area of composite laminar structure 10, the imaging area being circumscribed by dotted line 17 (FIG. 1). The relatively weak adhesion between layer 16 and sheet 12 makes possible, however, the accidental delamination of sheets 12 and 14, typically by the application of bending or other stress. An individual film unit not having the protection against delamination which is provided by the present invention, and on being subjected to physical stress, can begin to delaminate at one or more edges of the film unit. On propagation of an initial edge delamination into the major area intended for imaging (by further application of stress), there may result a complete delamination of the sheets with the image-forming layer 16 being adhered to sheet 14. Such delamination renders the film unit useless and is to be avoided where possible.

According to the present invention, protection of a unit 10 against premature delamination is afforded by a partial securement of the sheets thereof in the border region 15 defined by dotted line 17 and the circumscribing edges of sheet 14. The securement provided in border region 15 is partial, i.e., not complete, inasmuch as it is necessary for the provision of images on each of sheets 12 and 14 that the sheets be separable after thermal exposure in expansive region of the unit, defined by dotted line 17 and intended for image formation. Securement of the unit against premature sheet separation can be realized by adhering the sheets to one another in the border region (through intermediate layers therebetween) sufficiently to resist edge delamination on application of forces typically encountered in use of the unit in an imaging apparatus and method. The unit will be designed, however, upon application of force sufficient to overcome the predetermined edge adhesion, in the preferential adhesion of image-forming layer 16 to sheet 12 in border region 15.

Reference is made to the adhesion of sheets 12 and 14 to one another, substantially more strongly in border region 15 than in the remaining expansive region confined by the border sheet 12. In general, the strength of bonding in border region 15 can be accomplished using mechanical and/or chemical means. The strength of bonding will be that sufficient to prevent the initiation of edge delamination upon application of stresses during handling and traversing through a mechanical device used for the handling and processing of the composite laminate 10. Good results can be obtained, for example, by strengthening the border region 15 so that the peel strength required for separating the sheets in such region is twice or more than that needed to separate a like unit the edges of which are adhered substantially to the strength of adhesion of the sheets in the major expansive portion of the laminate. The amount of required strengthening will vary, however, with the particular laminar composite structure. In a structure such as that described in FIGS. 1 to 5, a peel strength in the major area will typically be in the range of about 0.8 grams/cm of width to about 8 g/cm of width. In such a case, adhesive bonding strength in border region 15 can be increased to a peel strength in the range of from 1.6 to 16 g/cm of width or higher. In a preferred structure, such as is shown in FIG. 4, good results are provided where the peel strength in the major area is in the range of from 1.1 to 2.8 g/cm and the peel strength in the border area is from 2.2 to 5.6 g/cm, or more.

From FIG. 1, it can be seen that preferred composite laminate 10 comprises congruent sheets 12 and 14. The periphery of composite laminar structure 10 can be defined by any of a variety of cutting means used to define cut 56, as shown in FIG. 6. Similarly, a variety of cutting means can be used to provide cut or score line 24 which defines one edge (20) of sheet 14. Line 24 can be cut at any time convenient in the manufacturing process, i.e., before, after or simultaneously with the cutting of the periphery of composite laminar structure 10 from the web material from which it is made.

It will be seen from FIG. 2, that sheet 14 is cut along line 24 only through frangible layer 16 to provide a composite tab structure which defines also the major portion of sheet 14. The length of the composite laminar structure 10 measured between the score line 24 and a rear edge may typically be about 25.5 cm (10 in.), its width may be about 20 cm (8 in.), and the dimension of the marginal portion 18 between its forward edge 26 and the score line 24 may be about 6.5 mm (0.25 in.). The thicknesses of the sheets 12 and 14 measure, respectively, about 0.013 to 0.178 mm (0.5 to 7 mil) and 0.038 to 0.0254 mm (1.5 to 10 mil), good results having been obtained with sheets of thicknesses of 0.044 and 0.178 mm (1.75 and 7 mil), respectively. Other dimensions may, of course, be substituted. Preferably, the corners of the sheets 12 and 14 are rounded.

In a common free edge 26 of the marginal portions 18 and 22 and the intermediate layer 16 there is provided a notch 28 which may conveniently serve as an alignment means for correctly placing the laminar film unit 10, or a plurality thereof, in a cassette (not shown) provided with a complementary protrusion in an orientation to ensure that the sheet 12 is facing upwardly for proper placement with an apparatus.

Figure 5:
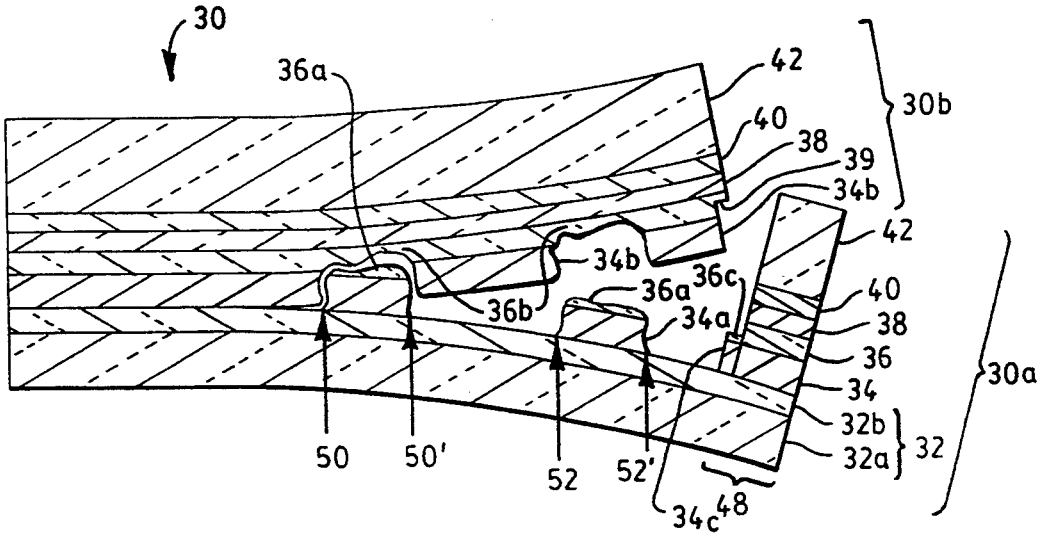
FIG. 5 is a diagrammatic cross-sectional view of the composite laminar structure of FIG. 4, shown in a state of partial separation and depicting certain aspects of its separation into complementary images.

Turning now to FIG. 4, there is shown a particularly preferred embodiment of a composite laminar structure of the invention, in the form of a thermal imaging laminar medium for the production of a pair of high resolution images by laser exposure. The laminar medium of FIG. 4 is shown in FIG. 5 in a state of partial separation.

Thermal imaging medium 30 includes a first sheet material 32 (comprising sheet material 32*a* and heat-activatable zone or layer 32*b*) having superposed thereon, and in order, porous or particulate image-forming layer 34, release layer 36, polymeric "bridge" adhesive/barrier layer 38, polymeric adhesive layer 40 and second sheet 40. In FIG. 4 is shown a cut line 44 for defining a tab or marginal portion 48 (FIG. 5) which facilitates the separation or delamination of medium 30 into a pair of complementary images. The various layers of medium material 30 are described in detail hereinafter.

Sheet 32 comprises a transparent material so that image-forming radiation can be transmitted therethrough for the imaging of medium 30. Among suitable materials are those mentioned previously in connection with sheets 12 and 14. An especially preferred sheet material from the standpoints of durability, dimensional stability and handling characteristics is polyethylene terephthalate.

Heat-activatable zone or layer 32*b* provides an essential function in the imaging of medium material 30 and comprises a polymeric material which is heat activatable upon subjection of the medium to brief and intense radiation, so that, upon rapid cooling, exposed portions of the surface zone or layer are firmly attached to porous or particulate image-forming layer 34. If desired, surface zone 32*b* can be a surface portion or region of sheet 32, in which case, layers 32*a* and 32*b* will be of the same or similar chemical composition. In general, it will be preferred that layer 32*b* comprise a discrete polymeric surface layer on sheet material 32*a*. Layer 32*b* will desirably comprise a polymeric material having a softening temperature lower than that of sheet material 32*a*, so that exposed portions of image-forming layer 34 can be firmly attached to sheet 12(12*a*). A variety of polymeric materials can be used for this purpose, including polystyrene, poly(styrene-co-acrylonitrile), poly(vinyl butyrate), poly(methylmethacrylate), polyethylene and poly(vinyl chloride).

The employment of a thin heat-activatable layer 32*b* on a substantially thicker and durable sheet material 32*a* permits desired handling of sheet 12 and desired imaging efficiency. The use of a thin heat-activatable layer 32*b* facilitates the concentration of heat energy at or near the interface between layers 32*b* and image-forming layer 34 and permits optimal imaging effects and reduced energy requirements. It will be appreciated that the sensitivity of layer 32*b* to heat activation (or softening) and attachment or adhesion to layer 34 will depend upon the nature and thermal characteristics of layer 32*b* and upon the thickness thereof.

Typically, sheet material 32 will vary in thickness from about 0.5 mil to seven mils (0.013 mm to 0.178 mm). Good results are obtained using, for example, a web material 32*a* having a thickness of about 1.5 to 1.75 mils (0.038 mm to 0.044 mm) carrying a layer 32*b* of poly(styrene-co-acrylonitrile) having a thickness of about 0.1 micron to five microns.

Image-forming layer 34 comprises an image-forming substance deposited onto heat-activatable zone or layer 32*b* as a porous or particulate layer or coating. Layer 34, also referred to as a colorant/binder layer, can be formed from a colorant material dispersed in a suitable binder, the colorant being a pigment or dye of any desired color, and preferably, being substantially inert to the elevated temperatures required for thermal imaging of medium 30. Carbon black is a particularly advantageous and preferred pigment material. Preferably, the carbon black material will comprise particles having an average diameter of about 0.1 to 10 micrometers (microns). Although the description hereof will refer principally to carbon black, other optically dense substances, such as graphite, phthalocyanine pigments and other colored pigments can be used.

The binder for the image-forming substance or layer 34 provides a matrix to form the porous or particulate substance thereof into a cohesive layer and serves to adhere layer 34 to heat-activatable zone or layer 32*b*. Layer 34 can range in thickness and typically will have a thickness of about 0.1 micron to about 10 microns. In general, it will be preferred form the standpoint of image resolution, that a thin layer be employed. Layer 34 should, however, be of sufficient thickness to provide desired and predetermined optical density in the images prepared from imaging medium 30.

Suitable binder materials for image-forming layer 34 include gelatin, polyvinylalcohol, hydroxyethyl cellulose, gum arabic, methyl cellulose, polyvinylpyrrolidone, polyethyloxazoline, polystyrene latex and poly(styrene-co-maleic anhydride). The ratio of pigment (e.g., carbon black) to binder can be in the range of from 40:1 to about 1:2 on a weight basis. Preferably, the ratio of pigment to binder will be in the range of from about 4:1 to about 10:1. A preferred binder material for a carbon black pigment material is polyvinylalcohol.

For the production of images of high resolution, it will be essential that image-forming layer 34 comprise materials that permit fracture substantially along the direction of arrows 50, 50',52 and 52', shown in FIG. 5, and that have a degree of cohesivity in excess of its adhesivity for heat-activatable zone or layer 32*b*. Thus, on separation of sheets 32 and 42 after imaging, layer 34 will separate in non-exposed areas from heat-activatable layer 32*b* and remain in exposed areas as porous or particulate portions 34*a* on sheet 32. Layer 34 is an imagewise disruptible layer owing to the porous or particulate nature thereof and the capacity for the layer to fracture or break sharply at particle interfaces.

Shown in FIG. 4, is release layer 36 which is included in thermal imaging medium 30 to facilitate the separation of images according to the mode shown in FIG. 5. Release layer 36 is designed such that its cohesivity or its adhesion to either adhesive/barrier layer 38 of porous or particulate layer 36 is less, in exposed regions, than the adhesion of layer 34 to heat-activated zone or layer 32*b*. The result of these relationships is that release layer 36 undergoes an adhesive failure in exposed areas at the interface between layers 36 and 38, or at the interface between layers 34 and 36; or, as shown in FIG. 5, a cohesive failure of layer 36 occurs within the layer, such that portions (36*b*) are present in image 30*b* and portions (36*a*) are adhered in exposed regions to porous or particulate portions 34*a*. Portions 36*a* of release layer 36 serve to provide surface protection for the image areas of image 30*a*, against abrasion and wear.

Edge lamination of sheets 42 and 32 of laminate 30 (through intermediate layers 34, 36, 38 and 40) secures laminate 30 against premature delamination of the sheets thereof. On separation of the sheets thereof after thermal imaging, in the manner shown in FIG. 5 for the production of respective images 30*a* and 30*b*, a portion 34*c* of image-forming substance (carrying a portion 36*c* of release layer 36) serves to provide a border about image 30*a*. Similarly, a border 39 is defined about image 30*b* characterized by the absence of image-forming substance (preferentially adhered as portion 34*c* to image 30*a*).

Release layer 36 can comprise a wax, wax-like or resinous material. Microcrystalline waxes, for example, high density polyethylene waxes available as aqueous dispersions, can be used for this purpose. Polymeric or resinous materials such as poly(methylmethacrylate) and copolymers of methyl methacrylate and monomers copolymerizable therewith can be employed. If desired, hydrophilic colloid materials, such as polyvinylalcohol, gelatin or hydroxyethyl cellulose can be included as polymer binding agents.

Resinous materials, typically coated as latexes, can be used and latices of poly(methyl methacrylate) are especially useful. Cohesivity of layer 36 can be controlled so as to provide the desired and predetermined fractioning. Waxy or resinous layers which are disruptible and which can be fractured sharply at the interfaces of particles thereof can be added to the layer to reduce cohesivity. Examples of such particulate materials include, silica, clay particles and particles of poly(tetrafluoroethylene).

Shown in FIGS. 4 and 5, over release layer 36, is polymeric "bridge" adhesive/barrier layer 38. One function of layer 38 is that of an adhesive to assist in the lamination of a sheet 32 carrying layers 34, 36 and 38 to sheet 42 carrying adhesive layer 40. In the production of medium 30, a preferred practice is to provide first and second elements, the first element comprising sheet 32 (carrying layers 34, 36 and 38) and the second element comprising sheet 42 carrying adhesive layer 40; and to, then, laminate the elements with their respective sheets outermost into a unitary laminate. This procedure provides an adhesive-to-adhesive contact between layers 38 and 40 and a substantially uniform bonding of the elements. The lamination can be performed under ambient room temperature, or with added heat. In general, good results are obtained by laminating at temperatures of from about 70° F. to about 115° F., i.e., about 21° C. to about 46° C.

If desired, and depending upon the nature of adhesive layer 40 and its bonding to release layer 36, bridge adhesive layer 38 can be omitted. Preferably, such a layer will be employed to "bridge" the adhesion of the aforesaid first element to the second element. Methacrylate copolymers can be used for such purposes, as can a variety of other polymeric materials. An especially preferred material is one which is elastic and non-brittle and which serves as barrier to permeation of mobile or fugitive species (e.g., polymerizable monomer) from adhesive layer 40 to release layer 36. Examples of preferred materials for adhesive and barrier layer 38 are described in the copending and commonly assigned patent application of K. J. McCarthy, et al., for BARRIER LAYER IN LAMINAR THERMAL IMAGING MEDIUM, U.S. Ser. No. 07/798,899, filed Nov. 27, 1991. An especially preferred material for this purpose is a layer of copolymer of vinylidene chloride and a copolymerizable ethylenically unsaturated monomer.

Sheet 42 can comprise any of the sheet materials described in connection with sheets 12, 14 and 32 and is adhered to layer 38 (or to layer 36 where layer 38 is omitted) by adhesive layer 40. Examples of suitable adhesive materials are described in the aforementioned International Application No. PCT/US87/03249 and in the pending patent application of Neal F. Kelly, et al., U.S. Ser. No. 07/616,853, filed Nov. 21, 1990. Among preferred adhesive materials described therein and useful in the production of imaging laminate 30 are photohardenable adhesives comprising a macromolecular organic binder and a photopolymerizable ethylenically monomer. A principal advantage of such adhesive materials is that they permit medium 30, while the adhesive layer is in an unhardened (uncured) condition, to be cut and handled with a reduced tendency toward undesired delamination at the interface of layers 32*b* and 34. Such adhesive materials, on subjection of medium 30 to a blanket UV exposure, are then photohardened to a durable base layer for image 30*b* of FIG. 5. As mentioned previously, it may be desirable to mask the marginal (tab) portion 48 of medium 30 against such UV exposure (conducted through sheet 42). Permeation of monomer from layer 40 into composite tab structure 48 increases the strength of the tab structure and reduces the tendency for the tab portion of sheet 42 carried by image 30*a* to delaminate and become detached from image 30*a*.

If desired, medium 30 can include an auxiliary layer to provide protection against the delamination of the medium. Thus, a stress-absorbing layer (not shown) can be incorporated between layers 32*a* and 32*b*, for protection against undesired delamination. A compressible or elongatable polyurethane layer can be used as such a stress-absorbing layer and is described in the patent application of Neal F. Kelly, U.S. Ser No. 616,854, filed Nov. 21, 1990.

Thermal imaging medium 30 is capable of absorbing radiation at or near the interface of heat-activatable zone or layer 32*b*. This is accomplished by using layers in medium 30 which by their nature absorb radiation and generate the requisite heat for desired thermal imaging, or by including in at least one of the layers, an agent capable of absorbing radiation of the wavelength of the exposing source. Infrared-absorbing dyes can, for example, be suitably employed for this purpose.

It may be preferred in some instances that a light-absorbing substance be incorporated into either or both of image-forming layer 34 and heat-activatable zone or layer 32*b*.

Thermal imaging laminar media of the invention can be imaged by creating a thermal pattern according to the information imaged. For example, a two-sheet laminar medium, as shown in FIGS. 1 and 4 can be fastened onto a rotating drum for exposure of the medium through sheet 12 or 32. A light spot of high intensity, such as is emitted by a laser, can be used to expose the medium in the direction of rotation of the drum, while the laser is moved slowly in a transverse direction across the web, thereby to trace out a helical path. Laser drivers, designed to fire corresponding lasers, can be used to intermittently fire one or more lasers in an imagewise and predetermined manner to thereby record information according to an original to be imaged.

Apparatus and methodology for forming images from thermally actuatable media such as the composite laminar of media the present invention are described in detail in the commonly assigned patent application of E. B. Cargill, et al., entitled, Printing Apparatus, U.S. Ser. No. 616,658, filed Nov. 21, 1990; and in the commonly assigned patent application of J. A. Allen, et al., entitled, Printing Apparatus and Method, U.S. Ser. No. 616,786, filed Nov. 21, 1990.

Reference has been made in particular to composite laminar structures suited for the production of images by thermal exposure. The improved edge sealing embodied in such structures can, however, be employed in structures other than those particular preferred embodiments. In general, it will be understood by those skilled in the art that edge sealing as described will be useful for the protection against premature delamination of the sheets of any of a variety of laminar composite sheet structures wherein the preferential adhesion of an image-forming substance to one of a pair of sheets is reversed, by thermal or other exposure, to provide complementarily abutting portions of frangible image-forming substance separable to the respective sheets. Depending upon the image-forming substance and the image-forming mechanism, the reversal of such preferential adhesion can be accomplished by either strengthening or weakening the adhesive bonding between the frangible image-forming substance and the respective sheets of the composite sheet structure.

What is claimed is:

1. A thermally imageable laminar composite structure comprising:

a frangible layer of an image-forming substance, said layer having first and second opposite surfaces;

a first sheet having an image-forming surface or zone adhered to said first surface at a first strength, abutting areas of said frangible layer being, upon exposure of said composite structure to intense image-forming radiation, adherable to said image-forming surface or zone at a strength greater than said first strength;

a second sheet adhered to said second surface at a predetermined substantially uniform strength, said predetermined substantially uniform strength being greater than said first strength and less than said second strength;

each of said first and second sheets of said composite structure being separable from each other, separation of said sheets after said exposure to said intense image-formation radiation being effective to provide portions of said frangible layer of image-forming substance on each of the separated sheets;

said first and second sheets of said composite structure being prebonded to each other through said layer of image-forming substance about a border region conforming to the periphery of said sheets, at a strength substantially greater than the force required to separate said sheets in the region of said composite structure confined by said border region prior to said exposure of said composite in said region confined by said border region to said intense image-forming radiation;

said image-forming substance upon separation of said first and second sheets being adhered in said border region to one of said sheets, thereby to provide on said one sheet a border in said image-forming substance.

2. The composite structure of claim 1 wherein said first and second sheets are bonded to each other through said layer of image-forming substance in said border region at a peel strength at least twice the force required to separate said sheets in the region confined by said border region.

3. The composite structure of claim 2 wherein said first and second sheets are bonded to each other through said layer of image-forming substance in said border region at a peel strength of from 2.2 to 5.6 grams per centimeter of width of said border region.

4. The composite structure of claim 1 wherein said frangible layer of image-forming substance comprises a layer of carbon black pigment in a binder therefor.

5. The composite structure of claim 4 having between said first sheet and said frangible layer a heat-activatable polymeric layer for adhering portions of said frangible layer to said first sheet, upon exposure of said composite laminar structure to intense radiation, at said second strength.

6. The composite structure of claim 5 wherein each of said first and second sheets comprises a transparent polymeric sheet.

7. The composite structure of claim 6 wherein said image-forming substance upon separation of said first and second sheets is adhered in said border region to said second sheet, thereby to provide a clear border about said second sheet.

8. The composite structure of claim 7 wherein said second sheet is thicker than said first sheet.

9. The composite structure of claim 8 wherein a marginal portion for facilitating separation of said first and second sheets is provided by a cut line severing said second sheet and frangible layer from the remainder of said second sheet and layer.

10. A method of prebonding a unitary laminar composite prior to an imagewise exposure of the composite whereby premature delamination of the composite is prevented, said method comprising the steps of:

providing a supply web of a composite laminar structure, said web structure comprising a frangible layer of an image-forming substance having first and second opposite surfaces, a first sheet having an image-forming surface or zone adhered to said first surface at a first strength, abutting areas of said frangible layer being, upon exposure of said composite laminar structure to intense image-forming radiation, adherable to said surface or zone at a strength greater than said first strength, and a second sheet adhered to said second surface at a predetermined substantially uniform strength, said predetermined substantially uniform strength being greater than said first strength and less than said second strength, each of said first and second sheets of said web of composite laminar structure being separable from each other, separation of said sheets after said exposure to said intense image-forming radiation being effective to provide portions of said frangible layer of image-forming substance on each of the separated sheets of said composite laminar structure;

establishing a heated band-like zone corresponding substantially to the predetermined boundaries of a composite laminar unit to be cut from said supply web of said composite laminar structure, said boundaries defining an expansive region therein, said establishing of heated band-like zone being done prior to the imagewise exposure of said expansive region;

cutting said boundaries of said unit substantially within said band-like zone and through said supply web of said composite laminar structure; and removing said unit from said supply web.

11. The method of claim 10 wherein said heated band-like zone in established in said supply web by contacting the opposed surfaces of said web with heated dies under pressure, said heated dies and pressure being sufficient to bond said first and second sheets to each other through said image-forming substance in said zone to a strength substantially greater than the force required to separate said sheets in the region bounded by said zone.

12. The method of claim 10 wherein said heated band-like zone is established in said supply web by subjecting said supply web in said band-like zone to radiation of an intensity sufficient by absorption of said radiation by said supply web in said zone to generate heat for the bonding of said first and second sheets to each other through said image-forming substance in said zone to a strength substantially greater than the force required to separate said sheets in the region bounded by said zone.

13. The method of claim 12 wherein said frangible layer of image-forming substance comprises a layer of carbon black pigment in a binder therefor.

14. The method of claim 13 wherein said supply web is subjected to exposure by laser in said zone and said image-forming substance is absorptive of said laser exposure and generates heat sufficient to bond said first and second sheets to each other through said image-forming substance in said zone.

15. The method of claim 14 wherein each of said first and second sheets of said supply web are transparent polymeric sheets.

16. The method of claim 15 wherein a marginal portion for facilitating separation of said first and second sheets of a unit cut from said supply web is provided by cutting said second sheet and frangible layer from the remainder of said second sheet and layer of said unit.

17. The method of claim 15 wherein said step of cutting said boundaries of said unit substantially within said band-like zone and through said supply web is performed by a reciprocal stamping cutter.

18. The method of claim 15 wherein said step of cutting said boundaries of said unit substantially within said band-like zone and through said supply web is performed by a laser cutter.

19. The method of claim 10 wherein said heated band-like zone is established by applying or generating heat sufficient in said zone to bond said first and second sheets through said image-forming substance to a peel strength of from 2.2 to 5.6 grams per centimeter of width of said border region.

20. The method of claim 11 wherein said dies are heated to a temperature of from about 120° C. to about 137° C. and are applied at a pressure of from about 1.4 to about 2.1 kilograms per square centimeter and for a dwell time of from less than one second to about ten seconds.

* * * * *